US007371317B2

(12) United States Patent
Newman et al.

(10) Patent No.: US 7,371,317 B2
(45) Date of Patent: May 13, 2008

(54) PROCESS FOR PRODUCING COKE

(75) Inventors: Bruce A. Newman, Ponca City, OK (US); Ivan G. McConkey, Grimsby (GB); Bruce R. Goddard, Ponca City, OK (US); James R. Roth, Ponca City, OK (US)

(73) Assignee: Conocophillips.Company, Houston, TX (US)

( * ) Notice: Subject to any disclaimer, the term of this patent is extended or adjusted under 35 U.S.C. 154(b) by 906 days.

(21) Appl. No.: 10/225,738

(22) Filed: Aug. 22, 2002

(65) Prior Publication Data

US 2003/0098260 A1 May 29, 2003

Related U.S. Application Data

(60) Provisional application No. 60/314,652, filed on Aug. 24, 2001.

(51) Int. Cl.
*C10G 9/14* (2006.01)

(52) U.S. Cl. ..... 208/131

(58) Field of Classification Search ..... 208/131
See application file for complete search history.

(56) References Cited

U.S. PATENT DOCUMENTS

| | | | | |
|---|---|---|---|---|
| 3,035,308 A | | 5/1962 | Ragoss et al. | |
| 3,338,817 A | * | 8/1967 | Zrinscak et al. | 208/131 |
| 3,344,057 A | * | 9/1967 | Patrick | 208/50 |
| 4,075,084 A | | 2/1978 | Skripek et al. | |
| 4,104,150 A | | 8/1978 | Romey et al. | |
| 4,219,405 A | | 8/1980 | Pietzka et al. | |
| 4,455,219 A | | 6/1984 | Janssen et al. | |
| 4,518,486 A | | 5/1985 | Jansma | |
| 4,547,284 A | | 10/1985 | Sze et al. | |
| 4,720,338 A | | 1/1988 | Newman et al. | |
| 4,822,479 A | | 4/1989 | Fu et al. | |
| 4,853,106 A | | 8/1989 | Grove et al. | |
| 4,929,339 A | | 5/1990 | Elliott, Jr. et al. | |
| 4,983,272 A | | 1/1991 | Stavropoulos | |
| 5,028,311 A | | 7/1991 | Shigley et al. | |
| 5,034,116 A | | 7/1991 | Newman | |
| 5,092,982 A | | 3/1992 | Becraft | |
| 5,128,026 A | | 7/1992 | Newman et al. | |
| 5,174,891 A | | 12/1992 | Becraft | |
| 5,645,712 A | * | 7/1997 | Roth | 208/131 |
| 6,048,448 A | | 4/2000 | Nirell | |

(Continued)

FOREIGN PATENT DOCUMENTS

EP 0155163 B1 12/1988

(Continued)

OTHER PUBLICATIONS

D.H. Stormont, "Delayed coking techniques feel effect of increased needle-coke demand," Oil and Gas Journal, Mar. 17, 1969, pp. 75-78.

(Continued)

*Primary Examiner*—Glenn Caldarola
*Assistant Examiner*—John Douglas
(74) *Attorney, Agent, or Firm*—Baker & McKenzie LLP

(57) ABSTRACT

A delayed coking process for producing more uniform and higher quality coke by increasing the drum inlet temperature of the feedstock at least 2° F. during a fill cycle.

24 Claims, 14 Drawing Sheets

U.S. PATENT DOCUMENTS

| | | | |
|---|---|---|---|
| 6,117,308 | A | 9/2000 | Ganji |
| 6,168,709 | B1 | 1/2001 | Etter |
| 6,332,975 | B1 | 12/2001 | Abdel-Halim et al. |

FOREIGN PATENT DOCUMENTS

| | | |
|---|---|---|
| EP | 0455504 B1 | 3/1995 |
| GB | 1380526 | 1/1975 |

OTHER PUBLICATIONS

A.A. Kutler et al., "Here is what's new in delayed coking," Oil and Gas Journal, Apr. 6, 1970, pp. 92-96.

Russ R Jakob, "Coke quality and how to make it," Hydrocarbon Processing, Sep. 1971, pp. 132-136.

Norman P. Lieberman, "Time for coking cycle can be routinely halved," Oil and Gas Journal, Aug. 29, 1983, 39-44.

Isao Mochida et al., "Optimum carbonization conditions needed to form needle coke," Oil and Gas Journal, May 2, 1988, pp. 73-77.

Harold Onder et al., "Everything you always wanted to know about petroleum coke," Svedala Industries Kennedy Van Saun, Sep. 1997, pp. 1-29.

John D. Elliott, "Shot Coke Design & Operations," Today's Refinery, Aug. 2000, pp. 17-19.

A.C. Silva, "Coke bed structure in a delayed coker," Carbon, vol. 38, No. 14, 2000, pp. 2061-2068.

"Project to study refinery coking processes," Oil & Gas Journal, May 3, 1999, p. 58.

F. Rodriguez-Reinoso et al., "Delayed Coking: Industrial and Laboratory Aspects," Carbon, vol. 36, No. 1, 1998, pp. 105-116.

"Latest coker designs increase liquid yields, reduce emissions," Oil & Gas Journal, Nov. 8, 1993, pp. 82-87.

PCT International Search Report for International Application No. PCT/US 02/26731, mailed Nov. 18, 2002.

* cited by examiner

PROCESS FOR PRODUCING COKE

RELATED APPLICATIONS

This application claims priority from U.S. Provisional Application Ser. No. 60/314,652, filed Aug. 24, 2001.

TECHNICAL FIELD

The present invention relates to a delayed coking process. More particularly, the invention relates to a delayed coking process for producing more uniform and higher quality coke.

BACKGROUND OF THE INVENTION

Coking processes have been practiced for many years and are an important source of revenue for many refineries. In a coking process, heavy hydrocarbon feedstock is thermally decomposed, or cracked, into coke and lighter hydrocarbon products. Of the various types of coking processes currently used in the petroleum refining industry, delayed coking has emerged as the technology of choice by most refiners due to its lower investment costs and its ability to produce comparable yields of products but of higher quality.

A typical delayed coking process is a semi-continuous process in which heavy hydrocarbon feedstock is heated to cracking temperature using a heat source such as a coker furnace. The heated feedstock is then fed continuously to a coking drum, where it reacts in its contained heat to convert the feedstock to coke and cracked vapors. The cracked vapors are passed overhead to a coker fractionator, condensed and recovered as lower boiling hydrocarbon products. The fractionator bottoms may be recycled to the feedstock if desired. When the coke drum contents reach a predetermined level, the feedstock supply is switched to another drum, and the full drum is cooled and de-coked. The entire process for one drum, from fill cycle start to fill cycle start, may require between 18 and 120 hours.

Depending upon system design, operating parameters and feedstock, delayed coking is capable of producing a range of coke grades having differing physical properties. Coke properties determine its use and economic value. A high quality grade of coke, needle coke, is a primary constituent of graphite electrodes used in electric arc furnaces employed in the steel industry. Needle coke is produced from low asphaltenic, highly aromatic, low metal and low sulfur feedstock and is characterized as having a low coefficient of thermal expansion ("CTE") and high density. Even small changes in coke CTE and density can have substantial effects on electrode properties. An intermediate quality grade of coke, anode coke, is used primarily for the production of anodes employed in aluminum manufacture. Anode coke, which has technical specifications and economic value that fall between those of needle coke and fuel coke, is produced from low sulfur and relatively low metal feedstock. While CTE is not a factor in the characterization of anode coke, higher coke density is desirable for such coke. The term "premium" is sometimes used to refer to needle coke, but because needle coke and anode coke have higher economic value than fuel coke, the term is also used, depending upon context, to refer to any coke having one or more qualities which make it superior to fuel coke. Fuel coke is used primarily for fuel for power stations and cement kilns. Fuel coke, which has the lowest economic value, is produced from high sulfur, high metal feedstock.

In a delayed coking process, feedstock is introduced to the coking drum during the entire fill cycle. If the fill cycle lasts for 30 hours, the feedstock first introduced to the coking drum is subjected to coking conditions for that 30 hour period of time. Each succeeding increment of feedstock, however, is coked for a lesser period of time and the final portion of feedstock introduced to the coking drum is subjected to coking conditions only for a relatively short period of time. In view of this, problems can be encountered in obtaining coke product having consistent properties throughout the drum. Coke produced near the top of the drum, where reaction times are short, generally has different physical properties than coke produced in the remainder of the drum. Unconverted feedstock in the coking drum at the end of the coking process can result in the formation of coke that is high in volatile matter. However, coke having varying levels of volatile matter can be found throughout a coke drum, suggesting that coke strength, porosity and particle size, are not consistent throughout the drum. Coke which is not consistent in properties throughout the drum presents problems in production of both electrodes for the steel industry and anodes for the aluminum industry. Such inconsistency can lead to poor electrode performance and/or premature cracking of the electrode.

In the production of coke, there are competing interests. High coking temperatures increase reaction rates and shorten reaction times, but decrease coke yield. Moreover, at a certain point, increased temperatures result in coke having higher CTE values. Low coking temperatures, in contrast, normally result in slower reaction rates and longer reaction times, but increase coke yield and produce coke having lower CTE values. Pressure, fill rate, and recycle ratio also affect coke yield and quality. It is necessary, therefore, to reach an acceptable point between low quality/high quantity coke production and high quality/low quantity coke production which provides the greatest amount of coke meeting industry quality specifications. In the manufacture of needle coke, it is known for example to carry out the coking reaction at lower coking temperatures and, after the drum is filled and feedstock introduction has ceased, to heat treat the resulting coke by contacting it with a non-coke forming material which is in the vapor state at a higher temperature than the coking temperature. This type of operation is undesirable due to the formation of a low density "fluff" material during the switch to the non-coke forming vapors. The problem of fluff formation has been addressed by carrying out the coking reaction at lower coking temperatures and, after the drum is filled and feedstock introduction has ceased, to heat treat the resulting coke by contacting it with an admixture of an aromatic mineral oil capable of forming coke and a non-coking material at a temperature equal to or higher than the coking temperature and optionally thereafter further heat treating the coke by contacting it with a non-coking material at a temperature higher than the coking temperature. Although this type of operation reduces fluff formation, it suffers from the drawbacks of the additional processing complexity associated with the use of the admixture and the additional processing time associated with the heat treatment steps.

It would be advantageous to provide a delayed coking process which can produce coke having improved physical properties and/or produce coke having more consistent physical properties throughout the coke drum. It would also be desirable to provide a simple and cost effective process that can increase the coke production capacity of existing coking facilities by, for example, decreasing, if not eliminating, the need to use a heat treatment step.

SUMMARY OF THE INVENTION

The invention provides a delayed coking process for making premium coke having improved properties. The process of the invention also provides operational benefits and advantageously improves the quality and uniformity of properties of coke throughout a coke drum. The delayed coking process of the invention can reduce the amount of high volatile matter coke often found near the upper region of a coking drum, and can also provide more uniform quality of coke throughout the drum. Advantageously, the process of the invention implements a temperature profile to improve the reaction kinetics of the coking process. This helps to alleviate variations in coke quality and/or yield due to batch-to-batch variations in feedstock. While the process of the invention is described in its application to needle coke, it also can be used with other grades of coke such as anode coke, for which reduced volatile matter, increased density, and/or greater uniformity of properties throughout the coke drum is desirable.

In one aspect of the invention, a delayed coking process for making premium coke is provided in which heated feedstock is supplied to a coking drum during a fill cycle at a first feedstock drum inlet temperature. During the fill cycle, the feedstock drum inlet temperature is increased at least about 2° F.

In another aspect of the invention, a delayed coking process is provided in which heated feedstock is supplied to a coking drum at a first average drum inlet temperature during about the first half of a fill cycle, and in which feedstock is supplied at another average drum inlet temperature during about the last half of the fill cycle. The average drum inlet temperature during about the last half of the fill cycle is at least about 2° F. higher than the first average temperature.

In a further aspect of the invention, a delayed coking process is provided in which a heated feedstock is supplied at a first drum inlet temperature that is lower than the drum inlet temperature conventionally used for the feedstock. The drum inlet temperature at which the feedstock is supplied to the coking drum is then increased during least a portion of the fill cycle to another temperature that is higher than the drum inlet temperature conventionally used for the feedstock.

In a still further aspect of the invention, a delayed coking process is provided in which heated feedstock is supplied to a coking drum at a first drum inlet temperature that is lower than the conventional drum inlet temperature for the feedstock. The drum inlet temperature at which feedstock is supplied to the coking drum is then increased during at least a portion of the fill cycle to another drum inlet temperature higher than the conventional first drum inlet temperature for the feedstock and is about 2° F. to about 80° F. higher than the first drum inlet temperature.

In yet a further aspect of the invention, a delayed coking process is provided which may be readily and advantageously combined with other process steps to achieve additional improvements in coking operations and/or coke quality.

BRIEF DESCRIPTION OF THE DRAWINGS

Like reference symbols in the various drawings indicate like elements.

DETAILED DESCRIPTION OF THE PREFERRED EMBODIMENTS

Figure 1:
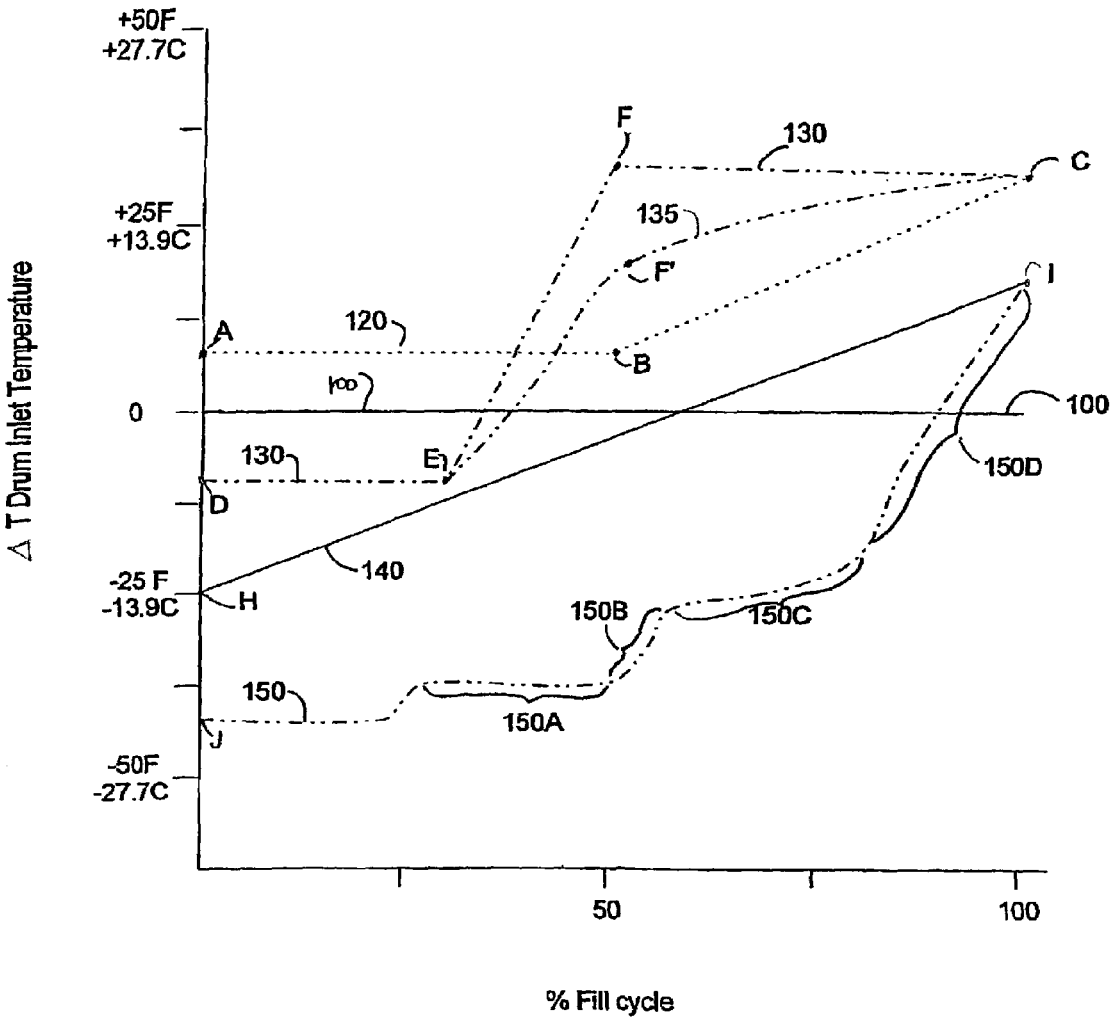
FIG. 1 is a chart illustrating exemplary temperature profiles.

The present invention is useful for delayed coking processes. For simplicity reasons, the term "delayed" generally has been omitted herein, but the invention is intended to encompass utility in such delayed coking processes. Also for simplicity reasons, the term "premium coke" generally has been used herein with its broader meaning, i.e., "any coke having one or more qualities which make it superior to fuel coke."

The following terms are intended to have the following meanings:

"conventional temperature" refers to the feedstock drum inlet temperature that would be used to produce coke of a particular quality from a given feedstock depending upon the operating conditions (e.g., length of fill cycle, operating pressure, or recycle ratio) if the same feedstock drum inlet temperature was used throughout the fill cycle;

"drum inlet" refers to the location where feedstock enters a coke drum;

"feedstock temperature" refers to the temperature of feedstock supplied to a coke drum, as measured at the drum inlet, in either degrees Fahrenheit or Celsius;

"fill cycle" is the time period during which feedstock is supplied to a coking drum, generally representing the time to fill a coke drum to an intended volume;

"fill rate" refers to the volume of feedstock per unit of time that is supplied to a coking drum;

"heat treatment" or "heat soak" refer to a process during which a coking or non-coking material, in either liquid or vapor form, is supplied to a coke drum following completion of the fill cycle;

"normal" is meant to encompass conventional process conditions;

"overhead outlet" or "overhead drum outlet" refers to the location where cracked vapors exit a coke drum;

"pressure" or "operating pressure" refers to the internal pressure of a coke drum during the fill cycle, as measured at the overhead outlet of a coking drum; and "profiling" or "profile" is indicative that a process parameter has been adjusted such that a value for that process parameter corresponds to a certain time during the coking process.

Feedstocks that are suitable for producing needle coke are low asphaltenic, highly aromatic, low metal and low sulfur feedstocks, while those suitable for producing anode coke are low sulfur and relatively low metal feedstocks.

Suitable feedstocks include, but are not limited to, decant oil, ethylene or pyrolysis tar, vacuum resid, vacuum gas oil, thermal tar, heavy coker gas oil, virgin atmosphere gas oil, extracted tar sand bitumen, or extracted coal tar pitch. Decant oil, also referred to as slurry oil or clarified oil, is obtained from fractionating effluent from the catalytic cracking of gas oil and/or residual oils. Ethylene or pyrolysis tar is a heavy aromatic mineral oil derived from the high temperature thermal cracking of mineral oils to produce olefins such as ethylene. Vacuum resid is a relatively heavy residual oil obtained from flashing or distilling a residual oil under a vacuum. Vacuum gas oil is a lighter material obtained from flashing or distillation under vacuum. Thermal tar is a heavy oil which is obtained from fractionation of material produced by thermal cracking gas oil, decant oil or similar materials. Heavy coker gas oil is a heavy oil obtained from liquid products produced in the coking of oils to coke. Virgin atmospheric gas oil is produced from the fractionation of crude oil under atmospheric pressure or above. Preferred feedstocks are those that provide high yields of coke having a low coefficient of thermal expansion (CTE), high density and crystalline particle structure, such as thermal tars, decant oils, pyrolysis tars and various types of petroleum pitches. Any of the preceding feedstocks may be used singly or in combination. In addition, any of the feedstocks may be subjected to hydrotreating, heat treating, thermal cracking, or a combination of these steps, prior to their use for the production of premium grade coke.

In a conventional delayed coking process, the drum inlet temperature at which feedstock is supplied to the coking drum is maintained substantially constant throughout the entire fill cycle. Such a temperature is referred to herein as a "conventional temperature" or a "conventional drum inlet temperature" and such a process is referred to herein as a "conventional delayed coking process." Conventional drum inlet temperatures can fall within a broad range, depending upon the particular feedstock used and the particular physical properties required in the coke product in order to meet specifications. Conventional drum inlet temperatures for a particular feedstock are also a function of the drum pressure, recycle ratio, fill rate, and other parameters.

By contrast to a conventional delayed coking process, the method of the invention involves increasing the feedstock drum inlet temperature to produce a more uniform and higher quality coke product. In one embodiment of the invention, feedstock is supplied to a coking drum at a first drum inlet temperature during the initial portion a fill cycle, and the feedstock drum inlet temperature is increased during at least another portion of the fill cycle.

In another embodiment of the invention, feedstock is heated and initially supplied to a coking drum during a fill cycle at a first drum inlet temperature and at sometime thereafter supplied at a higher temperature. The drum inlet temperature can be increased during a portion of the fill cycle, or throughout the entire fill cycle, for example, it may be increased sometime during the first 75% of the fill cycle or it may be increased sometime during the first 50% of the fill cycle.

In yet another embodiment of the invention, a feedstock having a first drum inlet temperature that is lower than the conventional drum inlet temperature is fed to the coking drum at the beginning of the fill cycle, and the drum inlet temperature is subsequently increased to a second drum inlet temperature that is at least about 2° F. higher than the conventional drum inlet temperature. Typically, the first drum inlet temperature of the present invention ranges from about 800° F. to 1000° F., and more preferably from about 820° F. to about 975° F. It has been found that increasing the feedstock drum inlet temperature at least about 2° F. higher than the first drum inlet temperature advantageously improves the coke product. Preferably, the temperature increase for a process of the invention is at least about 5° F. Also preferably, the temperature increase for the process is less than about 80° F.

The increasing temperature profile useful in the practice of the invention can be conducted in a variety of ways, and can be better understood from FIG. 1, which depicts drum inlet temperature plotted against the percentage of a fill cycle. It has been found that implementing any one of the increasing temperature profiles depicted in FIG. 1 advantageously improves the quality and uniformity of the coke throughout the height of a coking drum. Specifically, the amount of volatile matter in the upper region of the coking drum can be reduced.

Referring now to FIG. 1, line 100 represents a conventional drum inlet temperature, where the temperature remains substantially constant during the fill cycle, from beginning to end. Profiles 120, 130, 140 and 150 depict examples of temperature profiles useful for the invention, where the feedstock temperature at the coke drum inlet is increased during at least a portion of the fill cycle. In profile 120, the temperature remains constant during the initial half of the fill cycle, and then increases during the latter half of the fill cycle, at a substantially linear rate. The initial drum inlet temperature, depicted as point A, need not be higher-than-conventional.

In temperature profile 130, the temperature also remains constant initially, but only for a first interval equal to about the first one-third of the fill cycle. The feedstock temperature is then increased from point D at a substantially linear rate during a second interval of the fill cycle, which is depicted as the time between point E and point F, where F is about the half way point of the fill cycle. Similar to point A, starting temperature point D need not be lower-than-conventional temperature, but rather, can be equal to, or even higher-than-conventional. The length of the second interval from point E to F can be varied; however the temperature increase rate during the duration of the second interval is preferably adjusted so that the elevated temperature at point F is reached by about halfway into the fill cycle. Continuing on profile 130, the feedstock temperature then remains constant at the elevated level from point F to point C, which represents the latter half of the fill cycle. Alternatively, a different portion 135 of temperature profile 130 can be implemented, whereby two distinct temperature increase rates are used. Following profile segment 135, it is shown that the feedstock temperature is raised during a second interval between point E and point F' at a substantially linear rate; then from point F' to point C (representing about the latter half of the fill cycle), the temperature is again increased at a substantially linear but lower rate than the prior rate. Alternatively, segment 135 can be an arcuate portion of the profile, whereby a curved profile is achieved between point E and point C.

Another example of a temperature profile suitable for the invention is depicted as profile 140 in FIG. 1. In this profile, the feedstock drum inlet temperature gradually increases at a substantially linear rate from the beginning to the end of the fill cycle. Notably, the starting temperature at point H of profile 140 is lower than the conventional drum inlet temperature. Point H can also be lower than the initial temperature depicted by line 130. Due to the relatively slow increasing temperature rate for profile 140, the final temperature at the end of the fill cycle can be lower than, for example, that in profiles 120 and 130, yet still higher than a conventional drum inlet temperature.

Yet another temperature profile suitable for the practice of the invention is depicted as profile 150. As seen in FIG. 1, profile 150 is a step-wise yet gradual increase in the drum inlet temperature profile with a plurality of segments marked as 150A thru 150D. Similar to profile 140, the starting temperature J of the feedstock can be lower than the conventional drum inlet temperature. However, the final temperature at point I can be higher than the conventional drum inlet temperature. Within the segments 150A thru 150D, the temperature increase rate can vary segment to segment, can be linear or non-linear, and may even include segments with no increase (i.e. temperature remains constant).

In another temperature profile which is not depicted in FIG. 1, a delayed coking process for making premium coke can include supplying heated feedstock during a first half of a fill cycle at an initial average drum inlet temperature and then supplying the feedstock during the last half of the fill cycle at another average drum inlet temperature that is at least 2° F. higher than the initial average drum inlet temperature.

The increase in temperature for the practice of the invention can be accomplished in a variety of coking unit arrangements, including for example, using at least one furnace to vary the feedstock inlet temperature; using at least one furnace to heat one feed line and at least one separate, unheated feed line; using a coker recycle stream from, for example, a fractionator, and varying the ratio of coker recycle material to fresh feedstock that is supplied to the coking drum; or using at least two separate furnaces, one for each of two feed lines.

Figure 2:
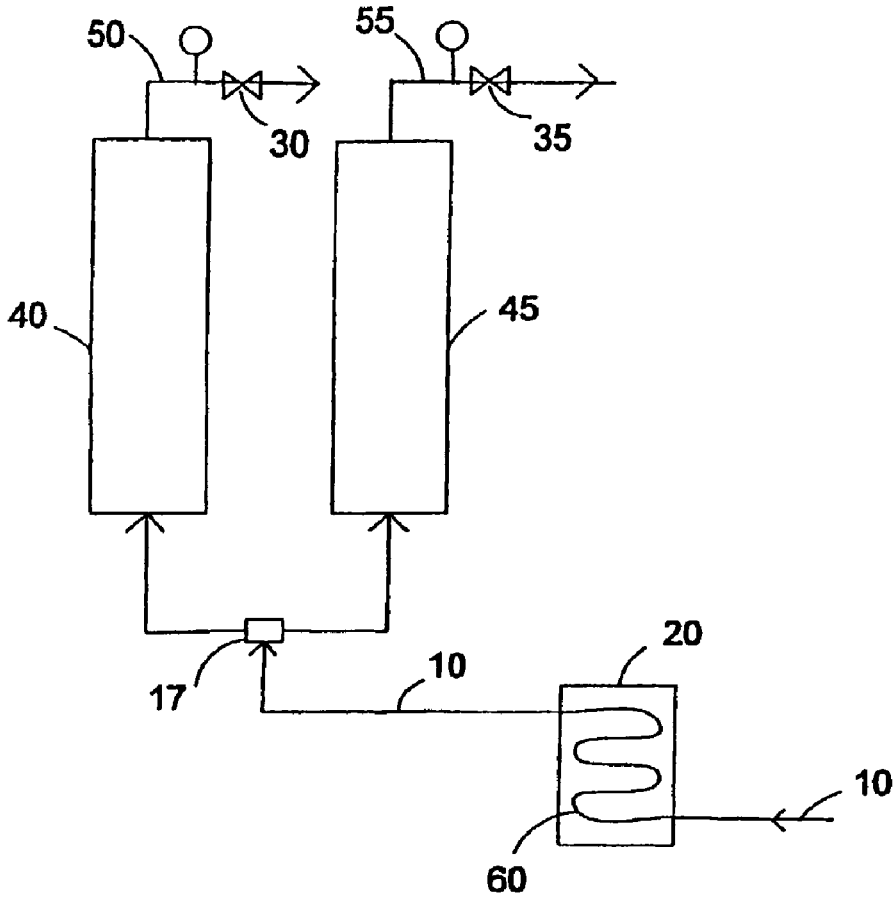
FIG. 2 is a process schematic of an embodiment of a basic coking system useful for the invention.

FIG. 2 provides a schematic of a basic coking process that includes a furnace 20 and two coking drums 40 and 45. A feedstock line 10 is heated in furnace 20 using a heat source (not shown) but depicted as coils 60, to provide feedstock at a certain intended temperature. The warmed feedstock leaving furnace 20 then enters either drum 40 or 45 at the bottom of either drum, as directed by a switching valve 17. To provide a desired temperature profile as described in the present invention, the heat supplied by furnace 20 is adjusted and varied to increase or maintain the feedstock temperature. Valves 30 and 35 can be used to control the pressure and allow vapors to leave the top of the drums 40 and 45, respectively. The gases can leave the top of the drums through line 50 or 55 and proceed to further recovery processes. Typically, with respect to drums 40 and 45, as one drum is "on cycle" (i.e., filling), the other drum is "off cycle" (e.g., quenching the coke, de-coking and preparing the drum for the next fill cycle).

Figure 3:
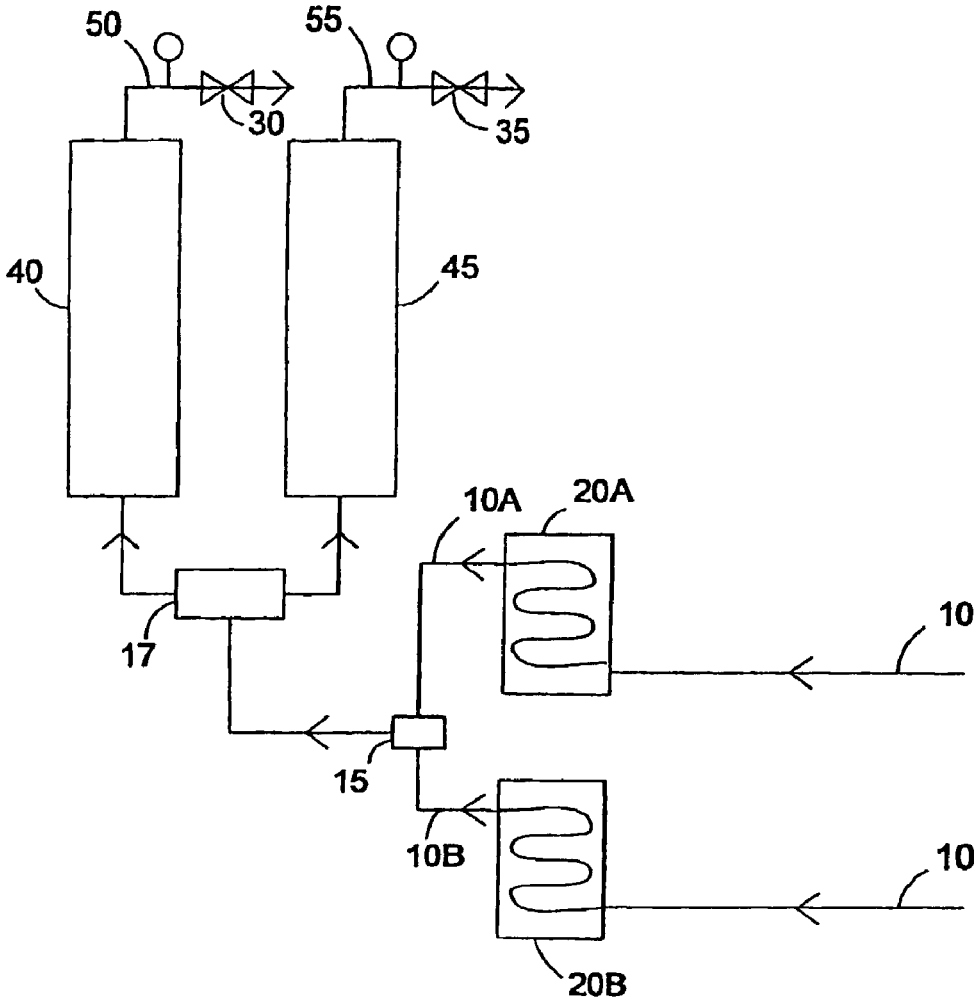
FIG. 3 is a process schematic of another embodiment of a coking system useful for the invention, with two furnaces.

An alternative coking system useful in practicing a process of the invention is depicted in FIG. 3. As shown in the figure, at least two furnaces 20A and 20B can be used to provide two feedstocks 10A and 10B, each preferably with a different temperature. By modifying the proportion or relative amounts of the two feedstock streams 10A and 10B using mixing valve 15, a mixed feedstock at a desired drum inlet temperature can be provided. Again, as described in FIG. 2, a switch valve 17 can be used to direct the heated feedstock into either drum 40 or 45.

Figure 4:
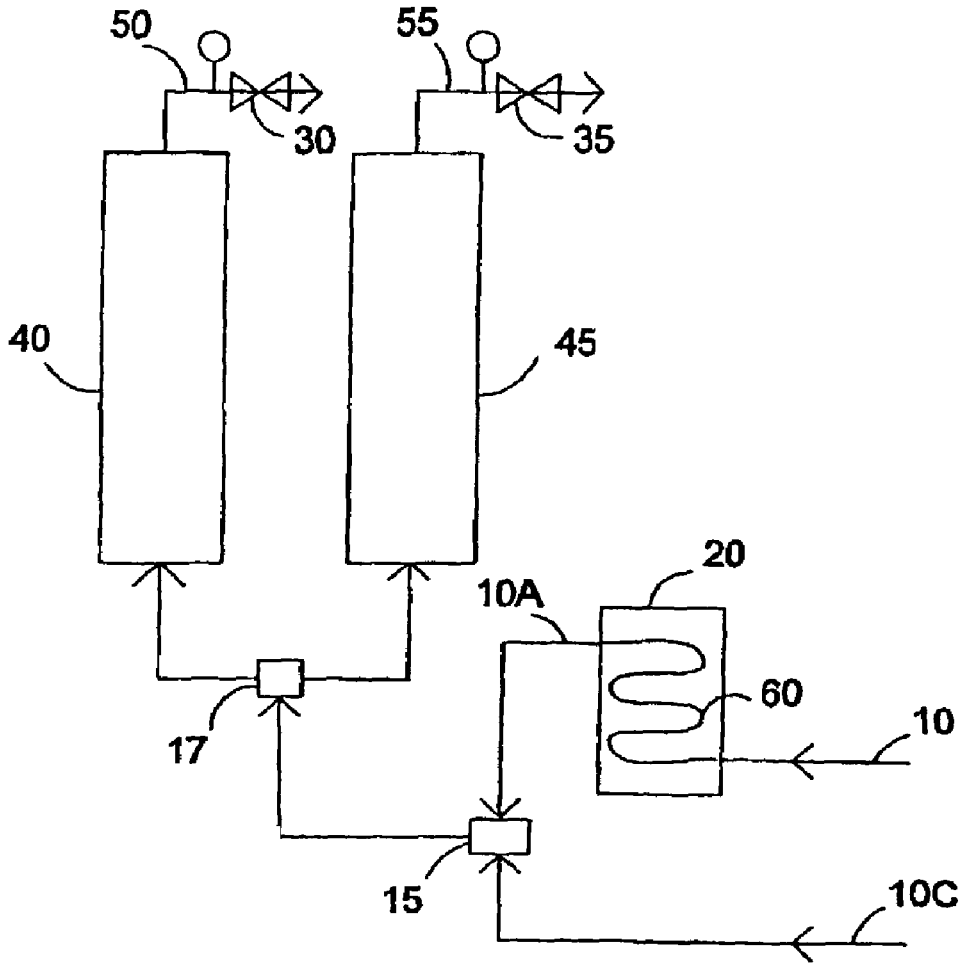
FIG. 4 is a process schematic of a further embodiment of a coking system useful for the invention, with a one furnace and two feed streams.

In a further alternative, a coking system as shown in FIG. 4 can be used to implement a temperature profile for a process of the invention. Similar to the system described for FIG. 3, at least two feedstock lines 10A and 10C can be mixed using mixing valve 15 to direct sufficient amounts or relative proportions from the two streams to provide feedstock having an intended drum inlet temperature. However, in this alternative system, one furnace is used to heat just one of the feedstock lines, such as 10A as shown in the figure. The second feedstock line 10C is an "unheated" bypass feedstock line. By mixing sufficient quantities or modifying the proportion of heated feedstock 10A with un-heated feedstock 10C, the temperature of a mixed feedstock can be adjusted and controlled. For example, the system can be operated so as to decrease the flow rate (and therefore the amount) of the unheated feedstock 10C while keeping the flow rate of the heated feedstock 10A constant during the fill cycle or portions of the fill cycle. The decrease in amount (e.g. volume) of unheated feedstock would result in a change (e.g. increase) in the temperature of the mixed feedstock. Use of a coking system with a bypass line as just described can be advantageous in reducing the potential for furnace fouling. Fouling can be attributed to recurring or periodic changes in furnace outlet temperatures that necessitate changes in firing rate.

Alternatively, a system useful for providing a temperature profile for a coking process can be achieved using a separation unit (e.g., fractionator, distillation column, separator) in conjunction with the basic coking process system comprising a drum and furnace. Any suitable separation unit capable of selectively separating lighter fractions of a material from the heavier fractions can be used. During operation, an outlet stream from the upper region of a coking drum can be fed into the separation unit. After separation, a heavy fraction stream from the separation unit can be recycled to the coking drum. The coker recycle stream can be mixed with an unheated feedstock and the admixture then heated in a furnace and supplied to the coking drum or the coker recycle stream can be supplied separately to the coking drum. To achieve a temperature profile whereby the feedstock temperature increases, the relative proportions of coker recycle stream to fresh feedstock or the flow rate of the coker recycle stream to the coking drum can be varied to adjust the feedstock drum inlet temperature.

It is contemplated that the systems shown and described in FIGS. 2 thru 4 may only be a portion of all the equipment useful in commercial, industrial scale coking operations. That is, additional equipment such as for example, pumps, filters, valves, gauges, drums, separators, fractionators, etc. may be added. Furthermore, there can also be variations in the configuration of equipment shown in the figures.

Optionally, in combination with temperature profiling, the fill rate of the feedstock entering a coking drum can be profiled. A decreasing fill rate profile advantageously may be used to increase the average reaction time coking feedstock experiences during the coking process without increasing the overall cycle time of the process and/or to shorten overall process cycle time, thereby increasing the capacity of the coking unit.

Table 1 calculates, for non-limiting illustrative purposes, how reaction time for a coking process may be increased by implementing a fill rate profile during a fill cycle. The model shown in Table 1 bases all calculations on a fill cycle of 20 hours. During an initial portion of the fill cycle, a volumetric fill rate of feedstock that is higher than a "normal" fill rate is used. During the latter portion of the fill cycle, a feedstock volumetric fill rate in another amount that is less than the aforesaid "normal" fill rate supplied to the coking drum is used for the calculation.

As seen in this model, various combinations of higher-to-lower fill rate profiles may be implemented to achieve increased average reaction times for a coking process. For example, in Table 1 model calculations show that where a 10% higher-than-normal fill rate is assumed for the first half the fill cycle, and an equal percentage (10%) lower-than-normal fill rate is assumed for the latter half of the fill cycle, then a projected increase of about 5% of average reaction time may be achieved. Greater increases in average reaction time are projected to be achievable by varying the portions of the fill cycle during which increased and/or decreased fill rates are used. For example, according to the model, using 20% high-than-normal fill rate for first three quarters of the fill cycle (15 hours) and 60% lower-than-normal fill rate for the last quarter of the fill cycle (5 hours) is projected to achieve a 15% increase in average reaction time.

By combining temperature profiling and fill rate profiling, it is believed that improved coke properties may be achieved. For example, CTE values (both flour and coarse grain), as well as the tendency of a coke process to produce "fluff" coke, may be lowered. The term "fluff coke" refers to highly porous, low density, frangible coke that may be formed near the top of a coke drum. Because it takes up much more volume in the coking drum per unit weight of coke, this fluff coke decreases the profitability of the coking operation by reducing net production of coke. Although not wishing to be bound by theory, it is thought that fluff coke may result from vaporization of unreacted or incompletely reacted feedstock, especially when pressure in the drum is decreased or a high-temperature distillate heat treatment is employed at the end of the fill period. It is thought that fluff coke formation may be reduced by decreasing the amount of feedstock that experiences low reaction time, such as by varying the fill rate. Referring again to Table 1, according to the model, a fill rate profile in which a 40% higher-than-normal fill rate is assumed for the first half of the fill cycle, and a 40% lower-than-normal fill rate is assumed for the last half of the fill cycle, is projected to reduce fluff coke formation by 40%.

Referring again to Table 1, according to the model, a fill rate profile in which a 40% higher-than-normal fill rate is assumed for the first half of the fill cycle and a 40% lower-than-normal fill rate is assumed for the last half of the fill cycle, is projected to reduce fluff coke formation by 40%. A fill rate profile in which a fill rate 20% higher-than-normal is assumed during the first 15 hours of a 20-hr fill cycle, and a 60% lower-than-normal fill rate is assumed for the last 5 hours of the fill cycle is projected to reduce fluff coke formation by 60%. Reducing the amount of fluff coke formed, or eliminating its formation entirely, is desirable, as it would increase the effective capacity of a coking drum and enhance the quality of the coke produced.

TABLE 1

| | Volumetric Fill Rate Changes | | Reaction Time | | % volume of feedstock supplied to coking drum during last 25% of | Projected % |
|---|---|---|---|---|---|---|
| Total Fill Cycle | 1st Fill Cycle Portion | 2nd Fill Cycle Portion | Average (hours) | Net % Increase | fill cycle (5 Hours) | Reduction in Fluff |
| 20 Hours | — | | 10 | — | 25 | — |
| | for 10 hrs, 10% higher-than-normal | for 10 hrs, 10% lower-than-normal | 10.5 | 5 | 22.5 | 10 |
| | for 10 hrs, 20% higher-than-normal | for 10 hrs, 20% lower-than-normal | 11 | 10 | 20 | 20 |
| | for 10 hrs, 40% higher-than-normal | for 10 hrs, 40% lower-than-normal | 12 | 20 | 15 | 40 |
| | for 15 hrs, 10% higher-than-normal | for 5 hrs, 30% lower-than-normal | 10.75 | 7.5 | 17.5 | 30 |
| | for 15 hrs, 20% higher-than-normal | for 5 hrs, 60% lower-than-normal | 11.5 | 15 | 10 | 60 |

Combining temperature profiling and fill rate profiling is also believed to reduce an undesirable process condition referred to as "foaming." Foaming can cause feedstock to be undesirably carried over to overhead lines. Foaming can be reduced or avoided by incomplete filling of the coking drum, but this solution to the problem reduces coker capacity. Foaming may also be reduced or avoided by application of chemicals (e.g. anti-foamants) to reduce the interfacial tension that enhances foam formation. Anti-foamants, however, can be costly, and the anti-foamants or their by-products can be passed to a subsequent processing unit such as a distillate hydrotreater, and cause premature and expensive deactivation of catalyst. Combining temperature profiling and fill rate profiling can advantageously reduce foaming without addition of costly chemicals or reduction in coker capacity by increasing the reaction time to which the feedstock is exposed. By reducing the fill rate near the end of the fill cycle when the possibility of feedstock carryover is greatest, more complete filling of the drums is possible and this, in effect increases the capacity of the coking drum.

Combining temperature profiling and fill rate profiling may provide further benefits, including reduced furnace fouling as a result of using lower temperatures and improved coke quality as a result of using lower coking temperatures and achieving longer average coking reaction times.

In another option, in combination with temperature profiling alone or temperature and fill rate profiling, the operating pressure may be elevated and/or profiled. Coke drum pressures in the range of atmospheric to about 200 psig have been reported. In general, coking at elevated pressures increases the amount of coke produced. In addition, improved macro and micro crystallinity in the coke product can be achieved by coking at elevated pressures. However, using an elevated or higher than normal pressure undesirably produces coke containing higher volatile matter, which results in coke having reduced strength and increased porosity upon calcination. The embodiment of the present invention in which elevated pressures and/or pressure profiling are used in combination with temperature or temperature and fill rate profiling can achieve the advantages of operating at elevated pressures while reducing or avoiding the drawbacks. For example, in order to minimize the formation of coke with high volatile matter that can result from the use of elevated coking pressures, a combination of an increasing temperature profile and a decreasing pressure profile may be used during the latter portion of the fill cycle. Alternatively, a combination of a decreasing fill rate profile and a decreasing pressure profile may be used during the latter portion of the fill cycle. As a result, the feedstock in the coking drum that experiences the greatest amount of reaction time is subjected to elevated pressures, while the feedstock that experiences the least amount of reaction time (i.e., feedstock supplied in the latter portion of the fill cycle) is subjected to lower pressure. It is within the scope of the invention to use an elevated drum pressure, such as a pressure of at least about 50 psig in combination with an increasing temperature profile. In another embodiment, a pressure of at least about 60 psig is maintained during the fill cycle.

Coking at an elevated pressure may also provide the capability of increasing the amount of coke produced. For example, operating at about 95 psig may produce about 10% more coke compared to a process conducted at about 70 psig.

If elevated pressures are used at the beginning of the fill cycle, a pressure decrease can be performed anytime during the fill cycle including throughout the entire fill cycle or for portions of the fill cycle. For example, the pressure decrease can be achieved by gradually decreasing the pressure inside the drum, from the start of the fill cycle, and continuing to the end of the fill cycle. This pressure decrease can be performed in various ways, such as, for example, in substantially linear fashion, in a substantially step-wise fashion, or combinations thereof. Alternatively, the pressure can be at a first pressure, i.e., an elevated or relatively higher pressure, for a first interval of the fill cycle, and then decreased to a second and lower pressure during a latter portion of the fill cycle, thereby creating a "pressure profile" representing the relationship between fill cycle time and pressure. Preferably, the pressure decrease occurs substantially within the last 10% to about 90% of the fill cycle.

Figure 10:
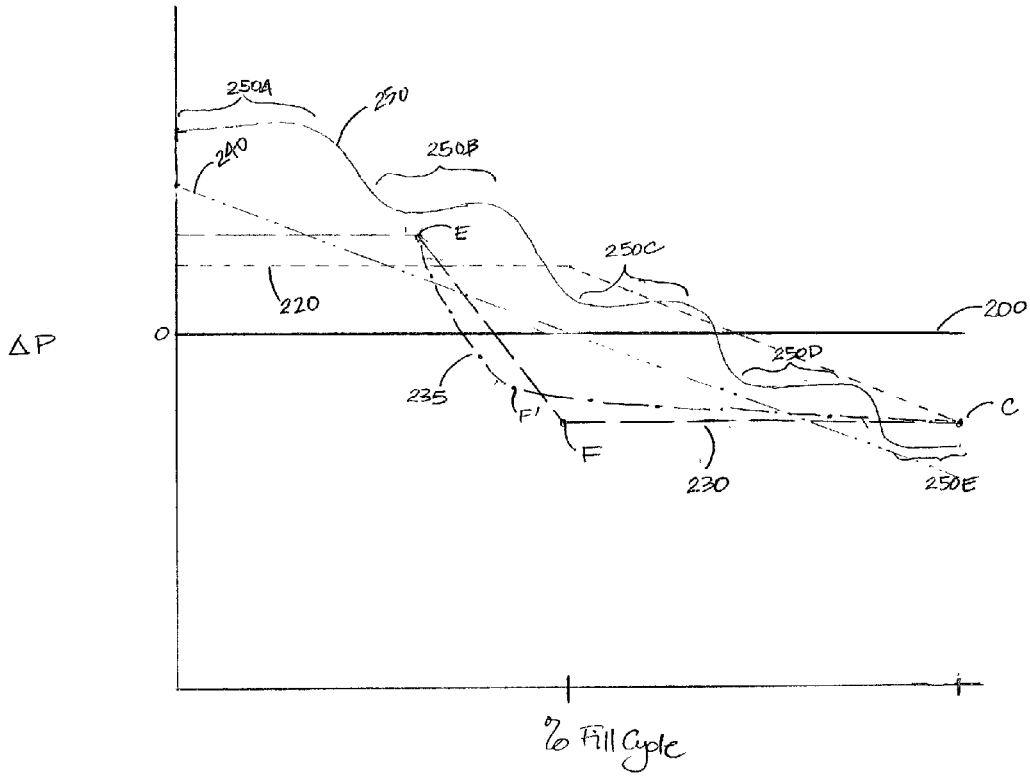
FIG. 10 is a chart illustrating exemplary pressure profiles.

Examples of suitable pressure profiles for the process of the invention are provided in FIG. 10. Implementing a pressure profile such as any one of those depicted in FIG. 10 can advantageously improve the uniformity of volatile matter throughout the length of a coking drum.

Referring now to FIG. 10, line 200 represents pressure for a conventional coke process, where pressure during a fill cycle remains substantially constant. Lines 220, 230, 240 and 250 depict examples of pressure profiles useful for the invention, where the drum pressure, which is initially elevated, is decreased during at least a portion of the fill cycle. In profile 220, the pressure remains constant during the initial half of the fill cycle, and then decreases during the latter half of the fill cycle, at a substantially linear rate. The pressure in profile 230 also remains constant initially, but only for a first interval equal to about the one-third of the fill cycle. The pressure is then decreased at a substantially linear rate during a second interval of the fill cycle depicted as the time between point E and point F, where F is about the midpoint of the fill cycle. The length of the first interval can be varied; however the pressure decrease rate during the duration of the second interval would then be adjusted to ensure the pressure at point F is reached by about halfway into the fill cycle. Continuing on profile 230, the pressure then remains constant at the decreased pressure level from point F to point C. Alternatively, a different portion 235 of pressure profile 230 can be implemented, whereby two distinct pressure decrease rates are used. Additional periods of decreasing pressure can be used if desired. Following profile segment 235, it is shown that the pressure is lowered during a second interval between point E and point F' at a substantially linear rate; then from point F' to point C (representing about the latter half of the fill cycle), the pressure is again decreased at a substantially linear but at a slower rate than the prior rate. Alternatively, segment 235 can be an arcuate portion of the profile, whereby a curved profile is achieved between point E and point C.

Another example of a pressure profile suitable for the invention is depicted as profile 240 in FIG. 10. In this profile, the pressure gradually decreases at a substantially linear rate from the beginning to end of the fill cycle.

Yet another profile suitable for the practice of the invention is depicted as profile 250. As seen in FIG. 10, profile 250 is a gradually decreasing pressure profile, optionally implemented as a step-wise decrease using a plurality of segments marked as 250A thru 250E. Within the segments 250A thru 250E, the pressure decrease rate can vary segment to segment, can be linear or non-linear, and may even include plateau segments during which the pressure remains constant.

In the process of the invention, the pressure can be decreased during at least a portion of the fill cycle by at least 5 psig. Preferably, the pressure varies between about 50 to about 125 psig, and more preferably between about 65 to about 125 psig. The operating pressure, if initially elevated, can be decreased to a pressure of about 5 psig and about 100 psig lower than the initial pressure during a portion of the fill cycle.

Further optional processing steps that can be practiced in combination with temperature profiling include, recycling a portion of an output stream from a coking drum and/or subjecting the contents of the coking drum to a heat treatment following the fill cycle. Streams that can be recycled include, for example, output streams from the coking drum or output streams from a fractionator.

Although the use of a temperature profile alone or in combination with pressure and/or fill rate profiling may reduce or eliminate the need for a heat treatment following the fill cycle, there may still be circumstances in which a heat treatment may be desirable and advantageous. A variety of factors, including feedstock type, process equipment, and process conditions can affect the desirability of using a heat treatment and the processing conditions, e.g., temperature and time, used for the heat treatment. Heat treatment processes and suitable materials for heat treatment are well known. When used in combination with the delayed coking process of the invention, the temperature of the heat treatment and/or the length of time during which the coke drum contents are subjected to the heat treatment can advantageously be less than that of conventional processes.

EXAMPLES

Comparative Example 1 and

Inventive Examples 2 and 3

Figure 5:
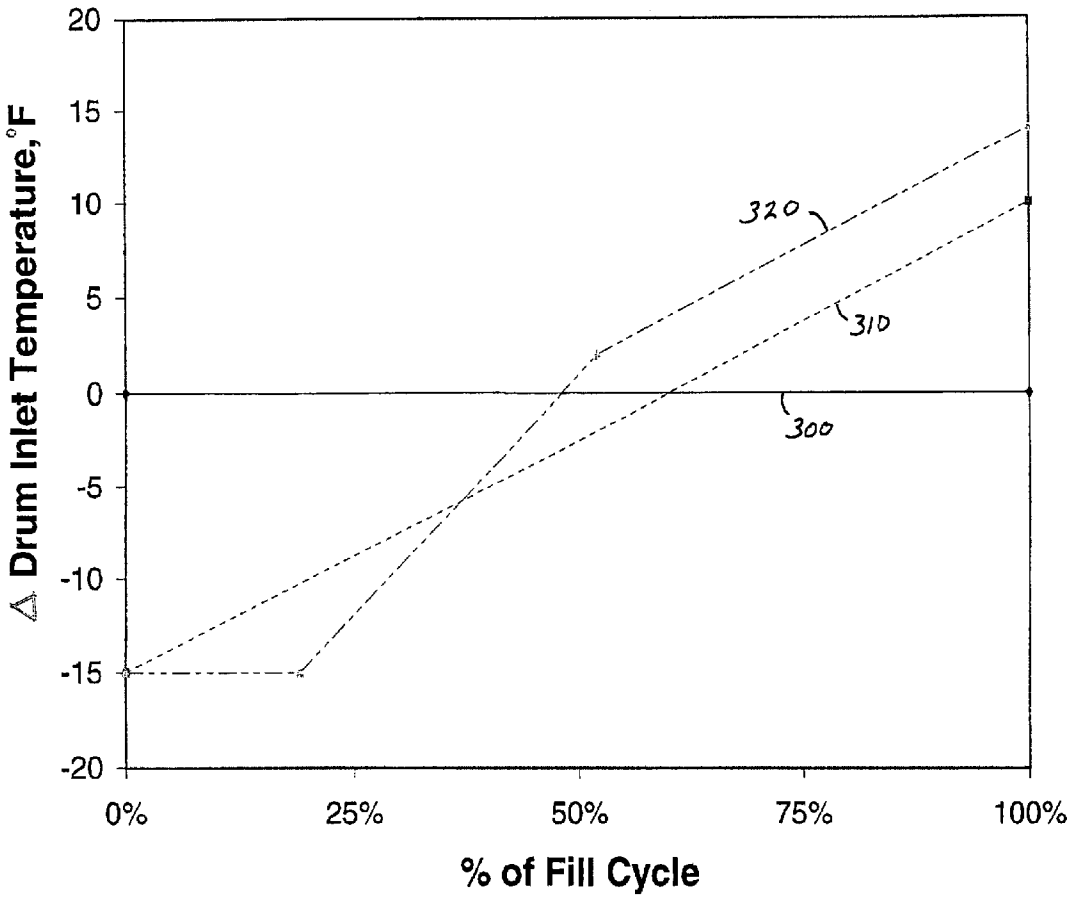
FIG. 5 is a chart illustrating the temperature profiles practiced for Examples 1-3.

Three commercial delayed coking processes were conducted utilizing a feedstock comprised of thermal tar and slurry oil (Alcor carbon content 6.5-7.5 wt %, sulfur 0.55-0.60 wt %). In Comparative Example 1, the feedstock was supplied at a substantially constant drum inlet temperature "T," i.e., according to a conventional delayed coking process. Processes according to embodiments of the invention were conducted for Examples 2 and 3, both of which used an increasing temperature profile. The temperature profiles used in Comparative Example 1, and Examples 2 and 3 are depicted on FIG. 5, and are referred to as profiles 300, 310, and 320, respectively. For all three processes, the duration of the fill cycle was the same, the volumetric fill rate was constant, and the operating pressure of each coking drum was maintained at 70 psig (482.6 kPa) throughout each fill cycle. Representative samples of the green coke from different levels (e.g. positions relative to the top of the coke bed) in the coke drum were removed from each process. Samples were collected from one drum produced in accordance with the process described above for Comparative Example 1. Samples were collected from two drums produced in accordance with the process described above for Example 2 (Examples 2a and 2) and Example 3 (Examples 3a and 3b). Analysis was performed on the samples using ASTM Method D4421, to evaluate the volatile matter content.

Table 2 provides the percent volatile matter (VM %) of the coke product from various levels within the drum for each of the Examples.

It was observed that compared to a coke made by the conventional process of Comparative Example 1, coke made by a process of the invention (Examples 2a and 2b, Examples 3a and 3b) is improved in a number of ways: the maximum amount of volatile matter was lower, the range in the amount of volatile matter was narrower, the average volatile matter for the entire drum (as sampled) was lower, and the standard deviation in the volatile matter was smaller.

Figure 6:
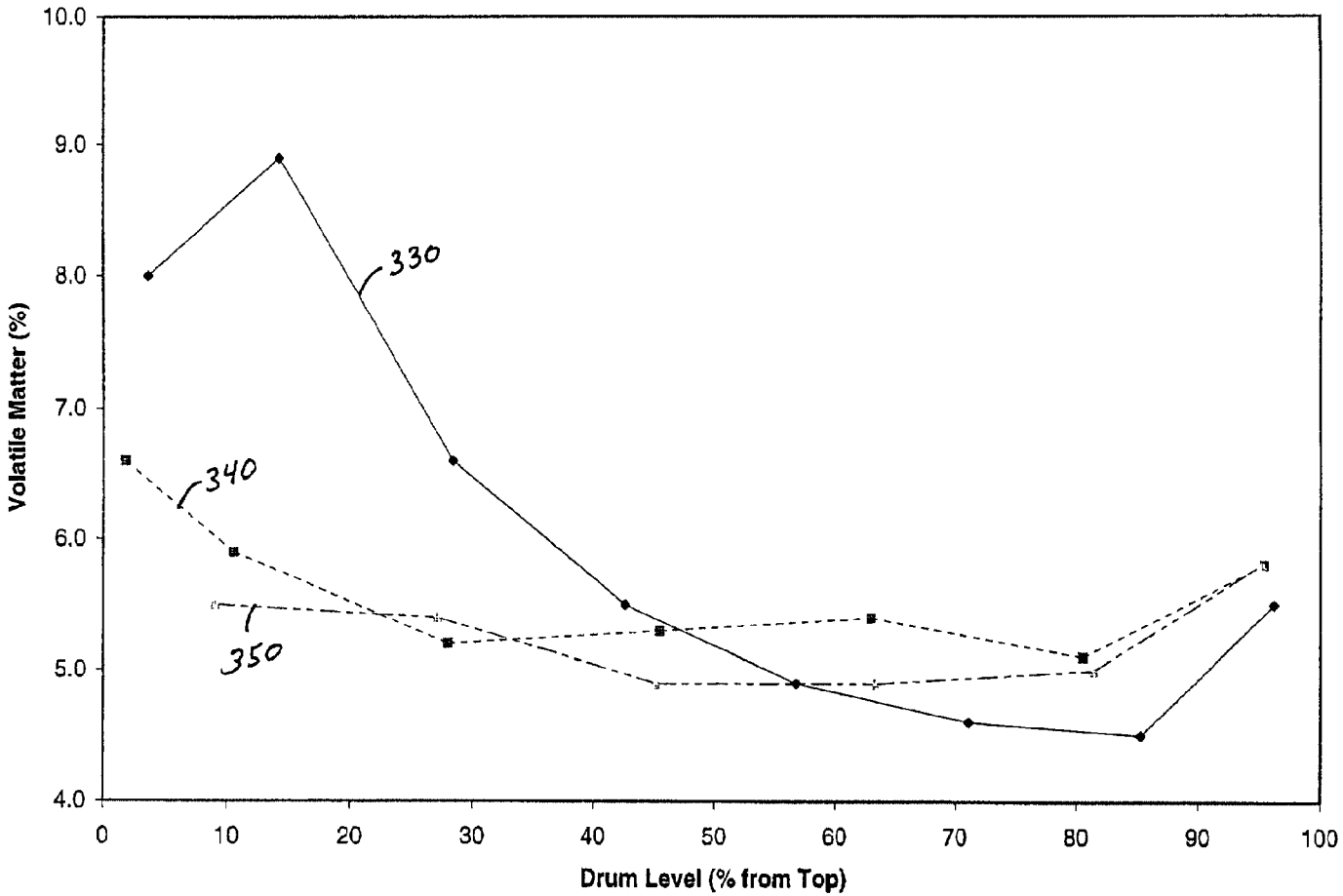
FIG. 6 is a chart depicting data of the volatile matter as a function of drum level from Examples 1 and 2.
Figure 7:
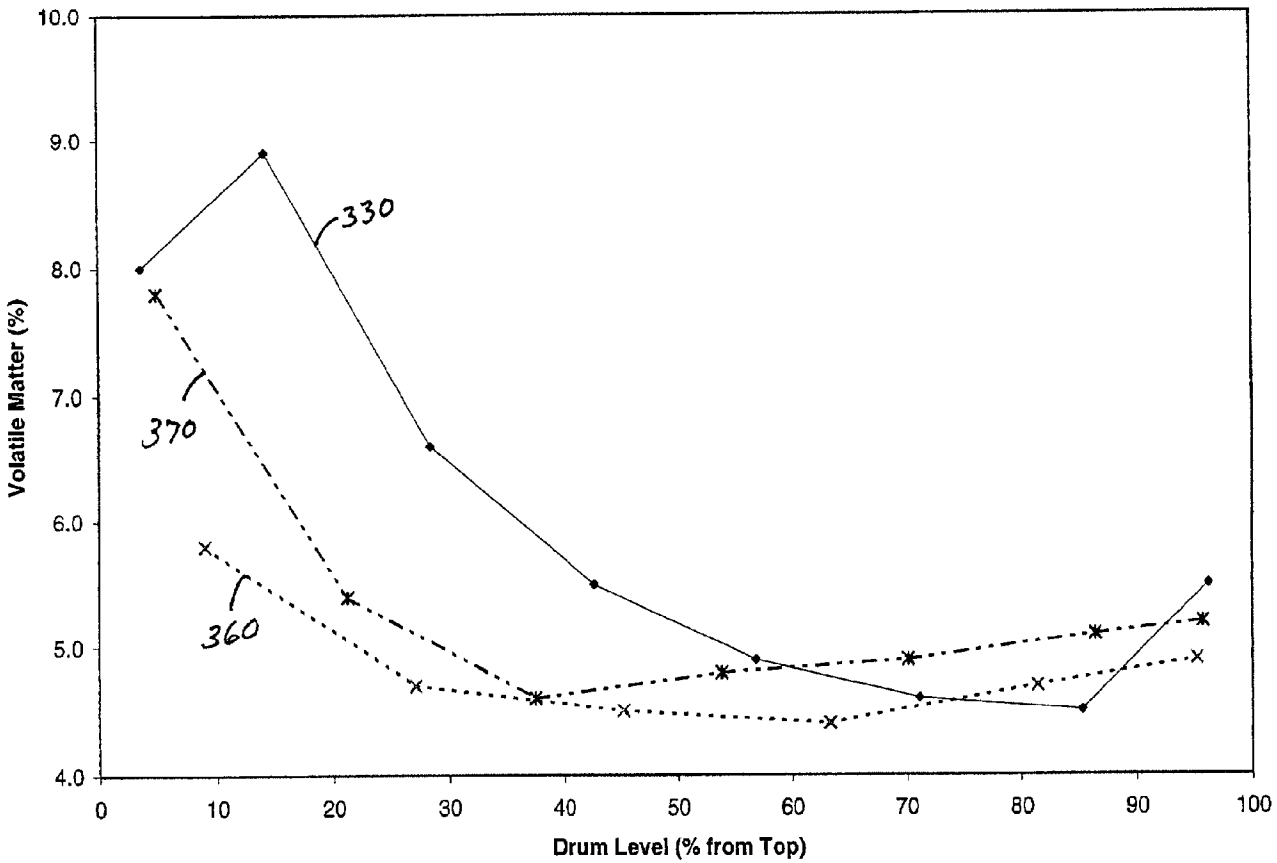
FIG. 7 is a chart depicting data of the volatile matter as a function of drum level from Examples 1 and 3.

The volatile matter was also plotted as a function of drum level. In FIG. 6 the percent volatile matter of Comparative Example 1, Example 2a and Example 2b are depicted as lines 330, 340 and 350 respectively. In FIG. 7 the percent volatile matter of Comparative Example 1, Example 3a and 3b are depicted as lines 330, 360 and 370 respectively. As can be seen from FIGS. 6 and 7 the amount of volatile matter in the coke produced by the process of the invention was more uniform throughout the drum than the amount of volatile matter in the coke produced by the conventional process, particularly in Examples 2a, 2b, and 3a. The amount of volatile matter in the coke produced by the process of the invention was also lower in the upper (40-50%) of the drum than the amount of volatile matter in the coke produced by the conventional process, particularly in Examples 2a, 2b, and 3a.

Example 4

A coking process was conducted utilizing the coking vessels and feedstock described in the previous Examples 1-3. For Example 4, a coking process according to preferred aspects of the invention was performed. The results were compared to those from Comparative Example 1.

Figure 13:
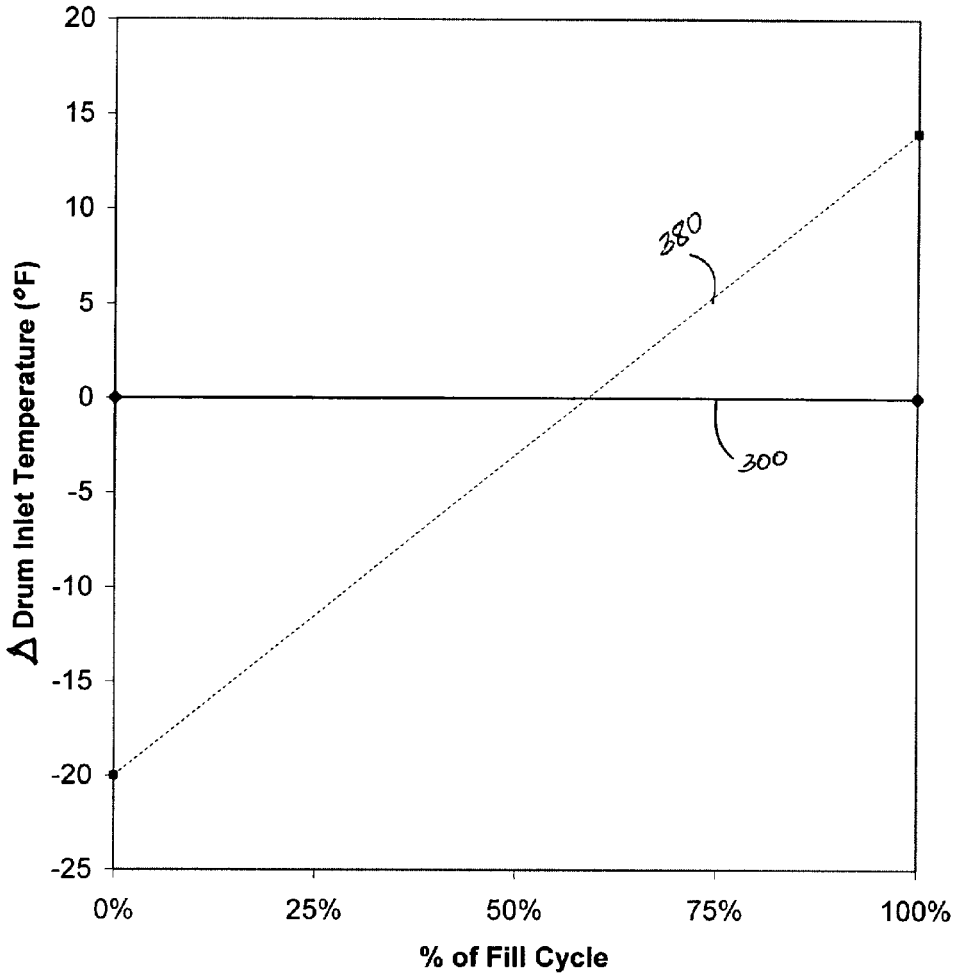
FIG. 13 is a chart illustrating the temperature profile practiced for Example 4.

For Example 4, feedstock was supplied having drum inlet temperature controlled according to a substantially linear increasing temperature profile, and the operating pressure was maintained at 95 psig (655.0 kPa) during the fill cycle. The feedstock was provided at a constant volumetric fill rate for the duration of the fill cycle, which was the same for each of the processes. The temperature profiles used in each process are depicted in FIG. 13, where lines 300 and 380 correspond to Comparative Example 1, and Example 4, respectively.

TABLE 2

| Example 1 | | Example 2a | | Example 2b | | Example 3a | | Example 3b | |
|---|---|---|---|---|---|---|---|---|---|
| Drum Level (% from Top) | VM (%) | Drum Level (% from Top) | VM (%) | Drum Level (% from Top) | VM (%) | Drum Level (% from Top) | VM (%) | Drum Level (% from Top) | VM (%) |
| 3.6 | 8.0 | 1.8 | 6.6 | 9.0 | 5.5 | 9.0 | 5.8 | 4.9 | 7.8 |
| 14.2 | 8.9 | 10.5 | 5.9 | 27.1 | 5.4 | 27.1 | 4.7 | 21.2 | 5.4 |
| 28.4 | 6.6 | 28.0 | 5.2 | 45.2 | 4.9 | 45.2 | 4.5 | 37.5 | 4.6 |
| 42.6 | 5.5 | 45.5 | 5.3 | 63.3 | 4.9 | 63.3 | 4.4 | 53.8 | 4.8 |
| 56.8 | 4.9 | 63.0 | 5.4 | 81.4 | 5.0 | 81.4 | 4.7 | 70.1 | 4.9 |
| 71.1 | 4.6 | 80.5 | 5.1 | 95.2 | 5.8 | 95.2 | 4.9 | 86.4 | 5.1 |
| 85.3 | 4.5 | 95.4 | 5.8 | — | — | — | — | 95.7 | 5.2 |
| 96.2 | 5.5 | — | — | — | — | — | — | — | — |
| Minimum | 4.5 | 5.1 | | 4.9 | | 4.4 | | 4.6 | |
| Maximum | 8.9 | 6.6 | | 5.8 | | 5.8 | | 7.8 | |
| Range | 4.4 | 1.5 | | 0.9 | | 1.4 | | 3.2 | |
| Mean | 6.06 | 5.61 | | 5.25 | | 4.83 | | 5.40 | |
| Standard Deviation | 1.63 | 0.53 | | 0.37 | | 0.50 | | 1.09 | |

As described above, Comparative Example 1 pertains to a conventional coking process where the operating pressure was maintained at 70 psig (482.6 kPa) throughout the fill cycle.

Representative samples of the resulting green coke from different levels (e.g. positions relative to the top of the coke bed) in the coke drum were removed for each process. Samples were collected from one drum produced in accordance with the process described above for Comparative Example 1. Samples were collected from two drums produced in accordance with the process described above for Example 4 (Examples 4a and 4b). The resultant samples were then analyzed by ASTM Method D4421 to evaluate the volatile matter content.

The percent volatile matter (VM %) of the cokes from each level of the drum are provided in Table 3.

TABLE 3

| Comparative Example 1 | | Example 4a | | Example 4b | |
|---|---|---|---|---|---|
| Drum Level (% from Top) | VM (%) | Drum Level (% from Top) | VM (%) | Drum Level (% from Top) | VM (%) |
| 3.6 | 8.0 | 17.7 | 6.4 | 6.6 | 5.4 |
| 14.2 | 8.9 | 23.0 | 5.1 | 20.5 | 5.2 |
| 28.4 | 6.6 | 38.3 | 4.8 | 36.3 | 5.2 |
| 42.6 | 5.5 | 53.6 | 5.1 | 52.1 | 4.7 |
| 56.8 | 4.9 | 68.9 | 5.0 | 67.9 | 4.7 |
| 71.1 | 4.6 | 84.2 | 4.8 | 83.9 | 4.4 |
| 85.3 | 4.5 | 95.9 | 5.3 | 95.8 | 5.5 |
| 96.2 | 5.5 | | | | |
| Minimum | 4.5 | 4.8 | | 4.4 | |
| Maximum | 8.9 | 6.4 | | 5.5 | |
| Range | 4.4 | 1.6 | | 0.5 | |
| Mean | 6.06 | 5.21 | | 5.01 | |
| Standard Deviation | 1.63 | 0.55 | | 0.41 | |

It was observed that compared to coke made by the conventional process of Comparative Example 1, coke made by a process of the invention (Examples 4a and 4b) is improved in a number of ways: the maximum amount of volatile matter was lower, the range in the amount of volatile matter was narrower, the average volatile matter for the entire drum (as sampled) was lower, and the standard deviation in the volatile matter values was smaller.

Figure 14:
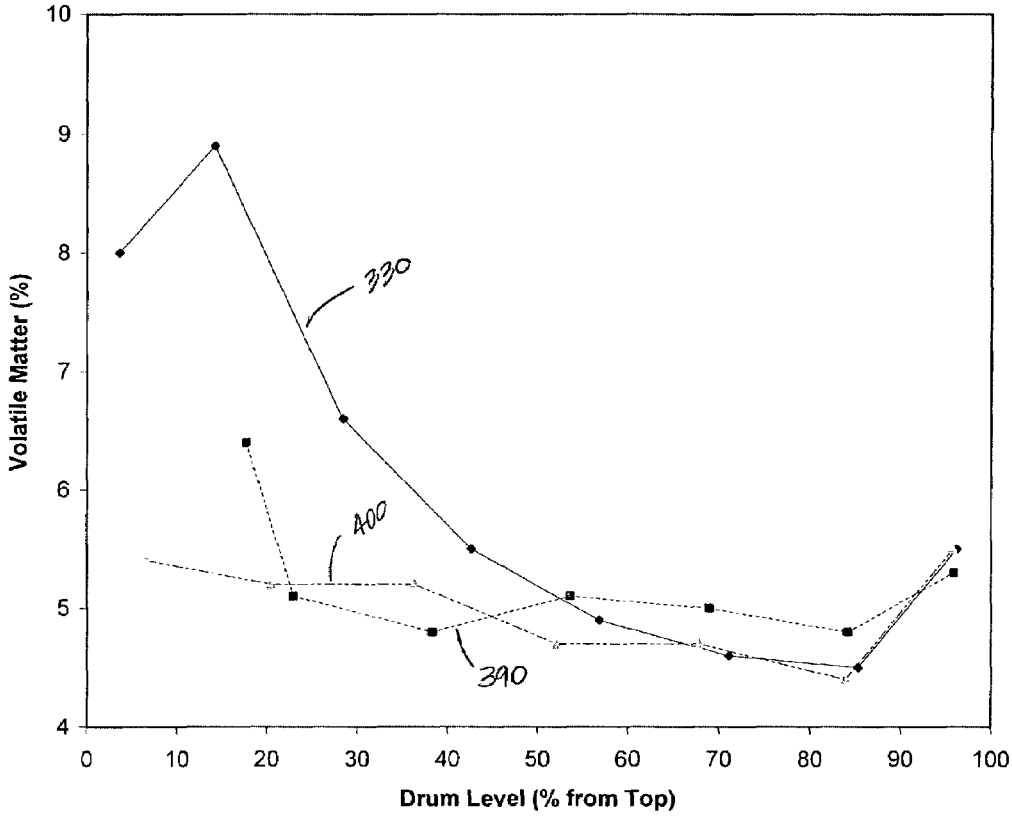
FIG. 14 is a chart depicting data of the volatile matter as a function of drum level from Example 4.

For pictorial representation, volatile matter was charted as a function of drum level and is provided in FIG. 14. Referring to FIG. 14, percent volatile matter of Comparative Example 1, and Examples 4a and Example 4b are depicted as lines 330, 390 and 400, respectively. As seen in the figure, the amount of volatile matter in the coke produced by the process of the invention was more uniform throughout the drum, than the uniformity of the coke produced by a conventional process. The amount of volatile matter in the coke produced by the process of Example 4 was also lower in the upper portion (approx. top 50%) of the drum, than in the coke produced by a conventional process.

Example 5

A series of coke samples made from a commercial feedstock (Feedstock A) were produced in a small laboratory scale coke vessel. The vessel was a vertically oriented tubular reactor having an outside diameter of approximately 1½ inches, and a length of approximately 16 inches. This vessel was heated by placing it into a heater block having embedded electrical resistance elements. The coke samples were produced by reacting the thermal tar at a constant coking temperature of 875° F. (which corresponded to a typical coking temperature within a full scale coke drum). The pressure of the coking vessel was maintained at 100 psig during the coking reaction. Each of the samples was allowed to react for one of different time intervals, namely 2, 4, 8, 16, 32, and 64 hours.

Figure 8:
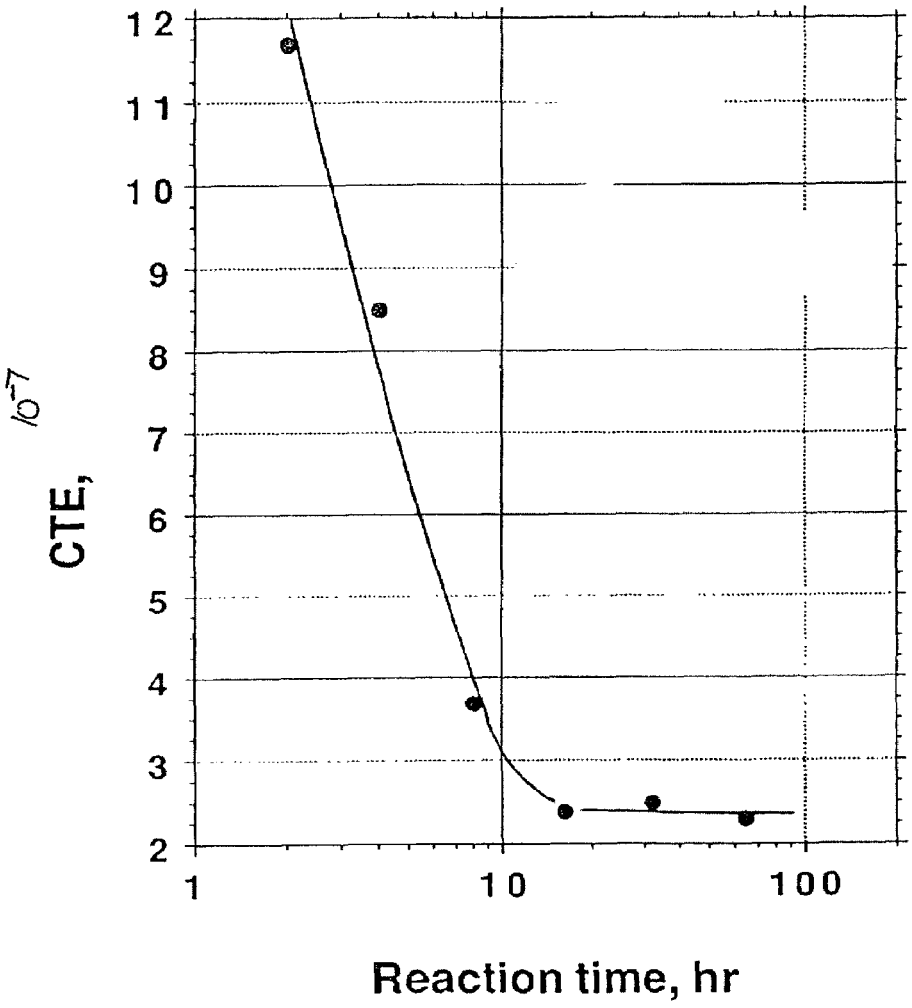
FIG. 8 is a graph depicting data from Example 5.

At the end of the designated reaction period, the vessel was cooled and the contents were withdrawn. The quality of the coke produced was analyzed by determining the coefficient of thermal of expansion (CTE) using a conventional x-ray technique to determine the intensity of the 002 graphite peak (U.S. Pat. No. 4,822,479, FIG. 2). These values are reported in Table 4, as well as in FIG. 8. As shown in FIG. 8, the CTE significantly decreased substantially as the reaction time increased.

Example 6

Figure 9:
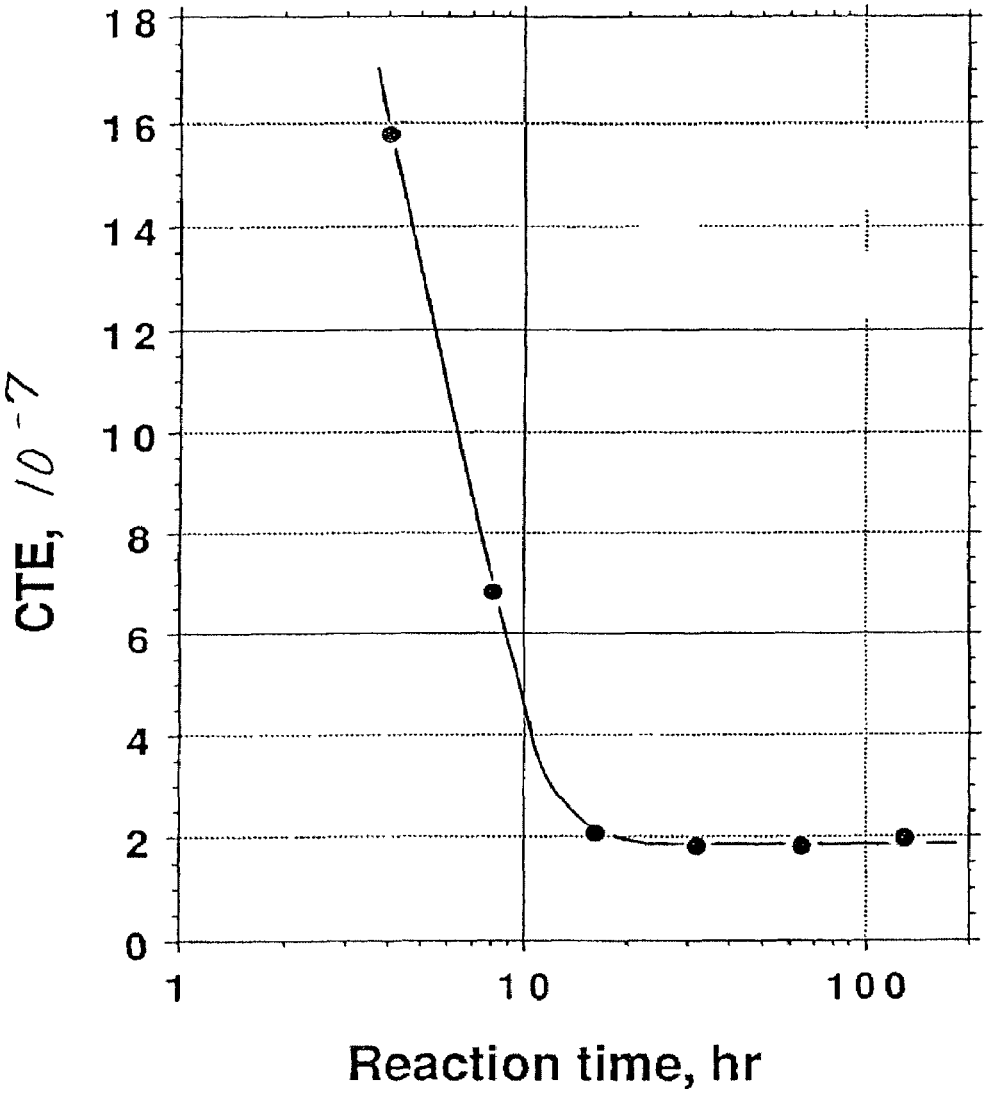
FIG. 9 is a graph depicting data from Example 6.

The same procedure as described in Example 5 was performed, except a different commercial feedstock, Feedstock B was used, and the coke vessel pressure was maintained at 60 psig. Each of the samples was allowed to react for one of different time intervals, namely 4, 8, 16, 32, 64 and 128 hours. FIG. 9 and Table 4 provide the data obtained from this example. As seen in FIG. 9, a significant decrease in the CTE was observed when the reaction time exceeded about 8 hours, and dramatically improved for longer durations of reaction time.

TABLE 4

| Reaction Time, hr | Example 5 (100 psig, Feedstock A) CTE ($1 \times 10^{-7}$) | Example 6 (60 psig, Feedstock B) CTE ($1 \times 10^{-7}$) |
|---|---|---|
| 2 | 11.7 | |
| 4 | 8.5 | 15.8 |
| 8 | 3.7 | 6.9 |
| 16 | 2.4 | 2.1 |
| 32 | 2.5 | 1.9 |
| 64 | 2.3 | 1.9 |
| 128 | — | 2.0 |

The batch operation performed in Examples 5 and 6 suggests that there can be a beneficial effect on the ultimate coke quality obtained in a commercial coking process due to an increased average reaction time available to the reactants in the coke drum. It appears that an increase of even a few hours can provide a significant decrease in the CTE values of the coke produced.

Examples 7-10

Coke was produced from a thermal tar (Alcor carbon content 8.3 wt %, sulfur 0.615 wt %) typically used in the production of premium or needle grade coke. A small laboratory scale coking vessel was used; the vessel was a vertically oriented tubular reactor having an outside diameter of approximately 1.5 inches (3.8 cm), and a length of approximately 16 inches (40.6 cm). The vessel was heated by inserting it into a metal block having embedded electrical resistance elements. The vessel was maintained at a temperature of about 900° F. (482.2° C.) for 8 hours at one of the following pressures levels:

| Example | Pressure |
|---|---|
| 7 | 30 psig (206.8 kPa) |
| 8 | 60 psig (413.7 kPa) |
| 9 | 90 psig (620.5 kPa) |
| 10 | 120 psig (827.4 kPa) |

After 8 hours, the vessel was cooled and the resulting coke contents were withdrawn. The quality of the coke produced from this reaction was analyzed to determine its normalized optical texture index which provided a measure of the density of disinclinations in the coke sample. Each sample was also evaluated by a conventional x-ray technique to determine the normalized height of the d002 x-ray peak. The samples were prepared for this x-ray testing by calcining the samples in a laboratory oven. The samples were allowed to cool before testing. The results of these tests are shown in Table 5.

TABLE 5

| Coking pressure | Optical texture index | Microcrystallinity ($d_{002}$ peak height) | Coke yield wt % |
|---|---|---|---|
| 30 psig (206.8 kPa) | 142.1 | 1.227 | 25.6 |
| 60 psig (413.7 kPa) | 110.2 | 1.227 | 31.9 |
| 90 psig (620.5 kPa) | 83.7 | 1.261 | 37.2 |
| 120 psig (827.4 kPa) | 74.5 | 1.289 | 41.2 |

Microcrystallinity is commonly measured using X-ray analysis. In those measurement techniques, the height of the 002 X-ray peak of calcined coke is measured. A high 002 peak height suggests that the coke has a well-ordered, highly crystalline structure, whereas a relatively low 002 peak height can indicate disordered, poorly-crystalline structure. As described in U.S. Pat. No. 4,822,479 in its FIG. 2, the normalized height of the 002 peak is shown to correlate linearly with the natural logarithm of flour CTE from a graphitized electrode. In a preferred aspect of the invention, the coke product can exhibit a normalized 002 peak height greater than about 1.20. More preferably, the normalized 002 peak height is greater than about 1.25.

Figure 11:
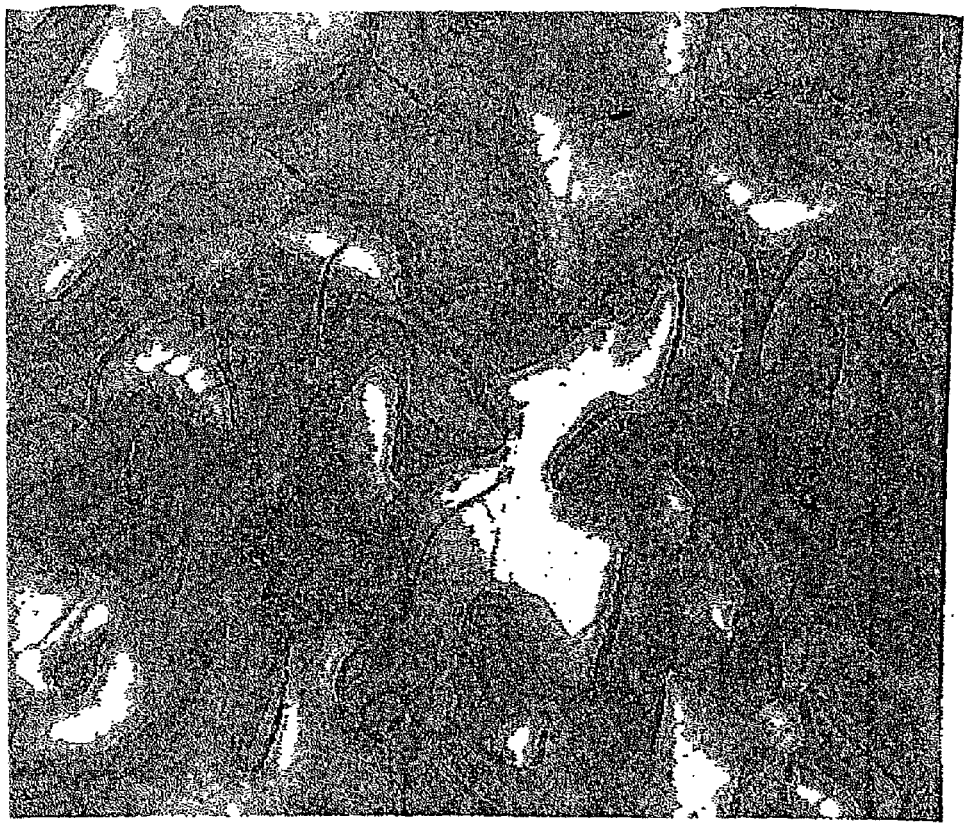
FIG. 11 is an illustration of a Scanning Electron Micrograph (SEM) of a coke having a normalized optical disinclination texture of about 50.
Figure 12:
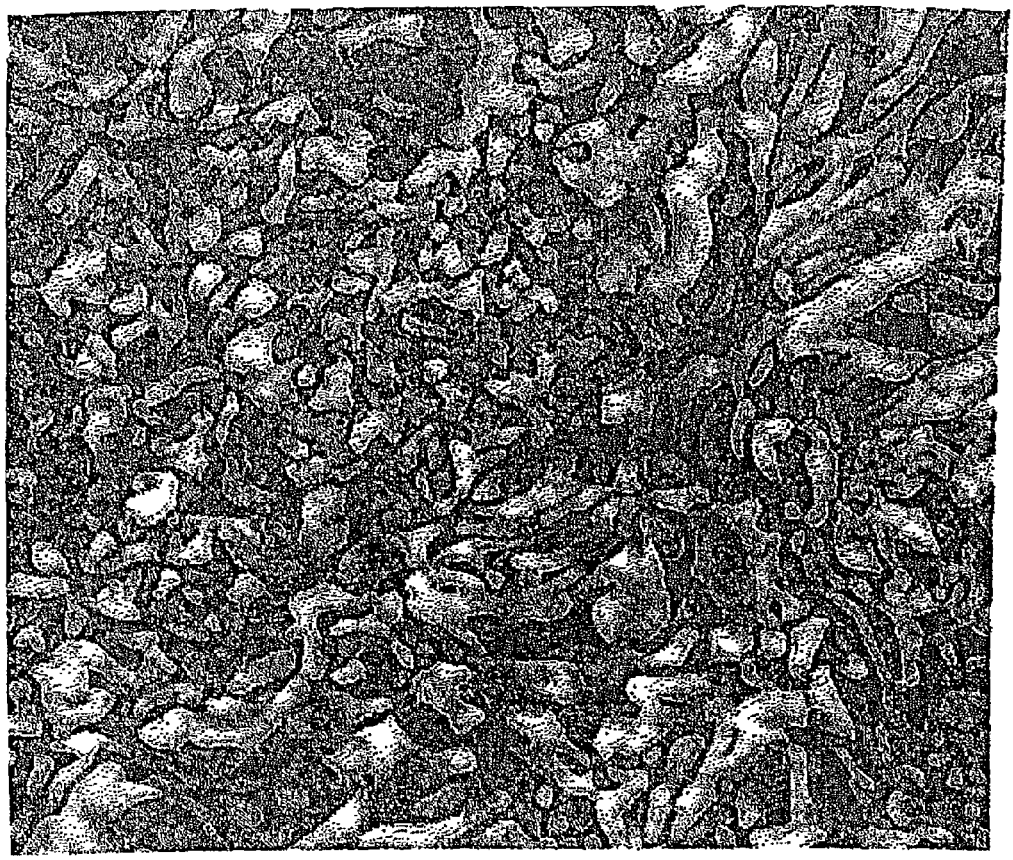
FIG. 12 is an illustration of an SEM of a coke having a normalized optical disinclination texture of about 200.

Macro-crystallinity of carbonaceous products (e.g. coke) is commonly measured using an optical method based on polarized light microscopy, where imperfections (referred to as disinclinations) in the crystalline structure can be observed under polarized light microscopy and the density of such disinclinations can be counted using optical image analysis. For illustrative purposes, FIG. 11 shows a coke product (magnified approximately 200×) having a normalized optical disinclination texture (density) or Optical Texture Index (OTI) of about 50. This sample would be considered "very good." FIG. 12, in contrast, is an example of a coke sample having an OTI of about 200, and can be considered "very poor" macro-crystallinity.

As seen in Table 5, a significant improvement in macro-crystallinity, as indicated by lower optical texture index, as well as a measurable improvement in microcrystallinity, was observed at the higher pressures. Improved coke yield was also achieved when the pressure was maintained at higher pressure. The batch operation performed in Examples 7-10 suggests there can be a beneficial effect on the ultimate coke quality obtained in a commercial coking process due to an increase in the operating pressure during the fill cycle.

Examples 11-16

Coke was produced using the small laboratory scale coking drum and thermal tar feedstock as described in Examples 7-10. The thermal tar was coked at one of the following pressures: 55 psig (379.2 kPa) or 115 psig (792.9 kPa); and at one of three temperatures 825° F. (440.6° C.), 875° F. (468.3° C.), or 925° F. (496.1° C.). See Table 6 below which provides the process conditions for each Example. Various reaction times were used, from about 2 to about 336 hours as reported in Table 6. The volatile matter in each batch of coke was determined according to ASTM Method D4421.

TABLE 6

| | Volatile Matter Produced (wt %) Coking Temp: | | | | | |
|---|---|---|---|---|---|---|
| | 825° F. (440.6° C.) | | 875° F. (468.3° C.) | | 925° F. (496.1° C.) | |
| | Coking pressure: | | | | | |
| | Example 11 55 psig 379.2 kPa | Example 12 115 psig 792.9 kPa | Example 13 55 psig 379.2 kPa | Example 14 115 psig 792.9 kPa | Example 15 55 psig 379.2 kPa | Example 16 115 psig 792.9 kPa |
| 2 hours | — | — | 38.1 | 40.9 | 8.6 | 10.5 |
| 4 hours | — | — | 25.9 | 28.7 | 5.4 | 6.4 |
| 6 hours | — | — | 18.8 | 20.2 | 4.8 | 5.8 |
| 7 hours | 41.6 | 44.5 | 9.1 | 11.7 | 4.6 | 4.8 |
| 16 hours | 23.7 | 28.8 | 6.7 | 7.7 | 3.8 | 4.0 |
| 24 hours | 13.2 | 17.4 | 5.1 | 5.7 | 4.0 | 4.8 |
| 32 hours | 11.6 | 15.2 | 4.6 | 4.9 | 3.7 | 4.0 |
| 48 hours | 8.0 | 9.5 | 4.1 | 4.3 | 3.9 | 3.9 |
| 96 hours | 5.1 | 5.9 | 3.9 | 3.9 | 3.5 | 3.6 |
| 144 hours | 4.5 | 5.1 | 3.8 | 3.8 | 3.4 | 3.4 |
| 192 hours | 4.2 | 4.4 | 3.8 | 3.7 | 3.1 | 3.7 |
| 264 hours | 4.1 | 4.2 | 3.7 | 3.8 | — | — |

TABLE 6-continued

| | Volatile Matter Produced (wt %) Coking Temp: | | | | | |
|---|---|---|---|---|---|---|
| | 825° F. (440.6° C.) | | 875° F. (468.3° C.) | | 925° F. (496.1° C.) | |
| | Coking pressure: | | | | | |
| | Example 11 55 psig 379.2 kPa | Example 12 115 psig 792.9 kPa | Example 13 55 psig 379.2 kPa | Example 14 115 psig 792.9 kPa | Example 15 55 psig 379.2 kPa | Example 16 115 psig 792.9 kPa |
| 336 hours | 3.9 | 4.1 | — | — | — | — |

(— Indicates data not retrieved)

It was observed that with lower reaction times, coking at higher pressures resulted in higher levels of volatile matter. This indicates that to achieve desirable levels of volatile matter (less than about 7%) at a certain pressure, the process could require longer reaction times. For example, at 875° F., coking at 55 psig for 16 hours achieved coke having volatile matter content lower than 7%. However, at the higher pressure of 115 psig, to achieve coke having less than 7% volatile matter, the coking reaction required 24 hours. The same trend was also found where the process operated at 925° F. Coking at 55 psig, at 925° F., and a reaction time of 4 hours achieved coke having less than 6% volatile matter. Operating at 115 psig, 925° F. required a reaction time of at least 6 hours to achieve that same low level of volatile matter.

While the delayed coking method of the invention is susceptible of various modifications and alternative forms, it is to be understood that specific embodiments thereof have been shown by way of example in both the examples and drawings which are not intended to limit the invention to the particular forms disclosed; on the contrary the intention is to cover all modifications, equivalents and alternatives falling within the scope and spirit of the invention as expressed in the appended claims.

What is claimed is:

1. A delayed coking method for making premium coke comprising:

supplying heated feedstock to a coking drum at a first average drum inlet temperature during about the first half of a fill cycle; and supplying said heated feedstock to said coking drum at another average drum inlet temperature during about the last half of said fill cycle;

wherein the average drum inlet temperature during the last half of said fill cycle is at least about 2° F. higher than said first average drum inlet temperature.

2. The method according to claim 1, wherein said drum inlet temperature is increased during the first 75% of said fill cycle.

3. The method according to claim 1, wherein said another drum inlet temperature is about 2° F. to about 80° F. higher than said first drum inlet temperature.

4. The method according to claim 1, wherein said first drum inlet temperature is about 800° F. to about 1000° F.

5. The method according to claim 1, wherein said drum inlet temperature is increased in a substantially linear fashion during at least a portion of said fill cycle.

6. The method according to claim 1, wherein said drum inlet temperature is increased in a substantially step wise fashion during at least a portion of said fill cycle.

7. The method according to claim 1, wherein said first drum inlet temperature is about 820° F. to about 975° F. and the pressure within said coking drum during said fill cycle is about 50 psig to about 125 psig.

8. The method according to claim 1, wherein said feedstock is supplied to said coking drum as an admixture of at least two separate feedstock streams having differing temperatures.

9. The method according to claim 8, wherein one of said at least two separate feedstock streams is a coker recycle stream.

10. The method according to claim 1, wherein said feedstock comprises at least two separate feedstock streams having differing temperatures and said feedstock drum inlet temperature is increased by modifying relative amounts of said at least two separate feedstock streams.

11. The method according to claim 10, wherein at least one of said at least two separate feedstock coking streams is supplied to said coking drum without passing through a coker furnace.

12. The method according to claim 1 wherein said first average drum inlet temperature is lower than conventional drum inlet temperature; and wherein said another average drum inlet temperature is higher than conventional drum inlet temperature and is about 2° F. to about 80° F. higher than said first average drum inlet temperature.

13. The method according to claim 1, further comprising at least one of the steps of a) supplying said feedstock to said coking drum at a first fill rate and decreasing said fill rate during at least a portion of said fill cycle to another fill rate lower than said first fill rate;

b) supplying said feedstock to said coking drum, said drum having a first pressure during said fill cycle, and decreasing said pressure during at least a portion of said fill cycle to another pressure lower than said first pressure;

c) supplying a coker recycle stream to said coking drum during at least a portion of said fill cycle; and d) after said coking drum is filled to a desired level, subjecting the contents of said coking drum to a heat treatment.

14. The method according to claim 13, wherein said feedstock is supplied to said coking drum at a first fill rate and said fill rate is decreased during at least a portion of said fill cycle to another fill rate lower than said first fill rate.

15. The method according to claim 14 wherein said coking drum is filled to an intended volume of feedstock, and about the last 15% of the intended volume is introduced into said coking drum during about the last 25% of said fill cycle.

16. The method according to claim 13, wherein said feedstock is supplied to said coking drum, said drum having a first pressure during said fill cycle, and said pressure is decreased during at least a portion of said fill cycle to another pressure lower than said first pressure.

17. The method according to claim 16 wherein said first pressure is greater than about 50 psig.

18. The method according to claim 16 wherein said another pressure is less than about 60 psig.

19. The method according to claim 16 wherein said pressure is decreased in a substantially linear fashion during at least a portion of said fill cycle.

20. The method according to claim 16 wherein said pressure is decreased in a substantially step-wise fashion during at least a portion of said fill cycle.

21. The method according to claim 16 wherein said pressure is decreased during at least the last half of said fill cycle.

22. The method according to claim 13, wherein said feedstock is admixed with a coker recycle stream to form an admixture and said admixture is supplied to said coking during at least a portion of said fill cycle.

23. The method according to claim 22, wherein said coker recycle stream comprises heavy hydrocarbon distillate.

24. The method according to claim 22, wherein said coker recycle stream comprises heavy coker gas oil.

* * * * *